US008783270B2

(12) United States Patent
Elsom-Cook et al.

(10) Patent No.: US 8,783,270 B2
(45) Date of Patent: Jul. 22, 2014

(54) HAIR PERMING RODS

(75) Inventors: Mark Elsom-Cook, West Midlands (GB); Steve Morris, West Midlands (GB)

(73) Assignee: Technoperm Limited, West Midlands (GB)

( * ) Notice: Subject to any disclaimer, the term of this patent is extended or adjusted under 35 U.S.C. 154(b) by 0 days.

(21) Appl. No.: 13/641,178

(22) PCT Filed: Apr. 13, 2011

(86) PCT No.: PCT/GB2011/050730

§ 371 (c)(1), (2), (4) Date: Jan. 7, 2013

(87) PCT Pub. No.: WO2011/128683

PCT Pub. Date: Oct. 20, 2011

(65) Prior Publication Data

US 2013/0092184 A1 Apr. 18, 2013

(30) Foreign Application Priority Data

Apr. 13, 2010 (GB) ..... 1006101.8

(51) Int. Cl.
*A45D 2/00* (2006.01)
*A45D 6/06* (2006.01)

(52) U.S. Cl.
USPC ..... 132/228; 132/221

(58) Field of Classification Search
USPC ..... 132/221, 245, 250, 252, 272, 228
See application file for complete search history.

(56) References Cited

U.S. PATENT DOCUMENTS

| | | | | | |
|---|---|---|---|---|---|
| 2,202,146 | A | * | 5/1940 | Gee | 132/221 |
| 2,677,380 | A | * | 5/1954 | Schoendorf | 132/250 |
| 2,747,585 | A | * | 5/1956 | Allen, Jr. | 132/221 |
| 2,809,643 | A | * | 10/1957 | Freeman et al. | 132/250 |
| 2,874,706 | A | | 2/1959 | Ficicchy | |
| 3,056,413 | A | * | 10/1962 | Unger, Jr. | 132/221 |
| 3,141,463 | A | * | 7/1964 | Hatton | 132/221 |
| 3,220,423 | A | * | 11/1965 | Zinzel | 132/206 |
| 4,403,621 | A | | 9/1983 | Paradise | |

FOREIGN PATENT DOCUMENTS

WO 2006072116 A1 7/2006

* cited by examiner

*Primary Examiner* — Rachel Steitz
(74) *Attorney, Agent, or Firm* — Fraser Clemens Martin & Miller LLC; J. Douglas Miller

(57) ABSTRACT

A rod for dispensing liquid to enable the penning of hair, wherein the rod comprises: a body around which in use hair is wrapped, said body comprising: a plurality of holes; and a chamber for holding liquid in fluid communication with the plurality of holes; wherein in use liquid is dispensed from the holes of the body thereby contacting the hair wrapped around the rod to enable perming of the hair.

19 Claims, 8 Drawing Sheets

HAIR PERMING RODS

FIELD OF INVENTION

The present invention relates to a method and apparatus for dispensing perming chemicals onto hair. In particular, the invention provides apparatus for dispensing chemicals directly onto hair wrapped around a perming rod in a controlled measured dose, thereby minimising the amount of chemicals used.

BACKGROUND TO THE INVENTION

It is known to curl hair using a mixture of chemicals. The hairstyle resulting from the chemicals is known as a perm or jheri-curl.

The modern perm, the so-called "cold wave perm" requires the use of strong chemicals. The modern method for achieving the perm is based on a chemical approach using 2 different solutions a perming solution and setting solution. The general method used follows these steps:

1) Insert the perming rods into the hair
2) Apply perming solution and leave for 20 minutes
3) Wash thoroughly
4) Apply setting solution and leave for 5 minutes
5) Remove rods
6) Shampoo as normal 1) A perming rod is similar to, but distinct from, 'curlers' or 'rollers'. It is a plastic device typically about 8 cm long and of varying diameters in the region of 1-3 cm. It may be a simple cylinder, or have a concave profile. There is normally a band or clamp (called a perming rubber) which holds the hair against the rod. A hairdresser winds the hair round each rod and clamps it in place. There are a variety of winding methods depending on the effect which is desired. Typically there will be 30 rods, in various sizes, used to produce a perm.

2) The perming solution breaks down the disulphite bonds between the peptides in the hair—destroying the elasticity. The perming solution will be different depending on whether it is an alkaline perm (typically sodium thioglycolate) or an acid perm (typically glycerol monothioglycolate). Acid perms take longer but are gentler, so are used on finer or more fragile hair. They also require some application of heat—normally via a hairdryer. The liquid used comes in a variety of solution strengths. The hairdresser must choose the most appropriate strength depending upon the type of hair (thickness, porosity, elasticity) and the effect desired. The solution is poisonous and may potentially damage skin. Hairdressers often wear plastic gloves while applying the solutions to prevent damage to the skin.

Applying the liquid is done by one of two methods. The traditional approach is to spray it on the hair. More recent options have 'dispenser' or applicator bottles. With these the hairdresser applies a strip of liquid along each rod and the liquid spreads round the rod. Rods designed for this purpose have small knobs on the surface to encourage the spread.

3) Washing (with the rods still in place) ensures that the solution is removed and that the process of damaging the hair is ended. This needs to be done thoroughly to prevent further chemical activity.

4) The second solution is typically Hydrogen Peroxide. it causes a chemical reaction which rebuilds the bonds between the peptides. it is normally left on the hair for about 5 minutes.

5) and 6) are self-explanatory.

Both the acid and alkaline perm involve strong chemicals which are poisonous and can cause burns if left on a person's skin. The application of the chemicals is potentially dangerous and it is therefore desirable to ensure that no excess chemicals are used during the perming process.

To mitigate some, if not all of the above problems, there is provided apparatus for the even distribution of the liquid through the hair, to minimise the likelihood of contacting the chemicals on the scalp and to make the process of applying the chemicals easier for the hairdresser.

According to an aspect of the invention there is provided a rod for dispensing liquid to enable the perming of hair, wherein the rod comprises: a body around which in use hair is wrapped, said body comprising: a plurality of holes; and a chamber for holding liquid in fluid communication with the plurality of holes; wherein in use liquid is dispensed from the holes of the body thereby contacting the hair wrapped around the rod to enable perming of the hair.

According to a further aspect of the invention there is provided a perming rod enabled to dispense liquid, the rod comprising: a body around which hair is wrapped, said body comprising: an outer surface comprising a plurality of holes; an inner surface comprising a first channel (or group of channels) extending at least part of the length of the barrel, the first channel (or group of channels) in fluid communication with one or more of the holes in the outer surface; a first container of liquid to be dispensed, said first container being positionable so as to be in fluid communication with said first channel (or group of channels); wherein in use, the first container introduces the liquid into the first channel and said liquid is dispensed via the holes in the outer surface of the rod.

Other aspects and features of the invention will be apparent from the appended claims and the following specific description which is given by way of example only.

BRIEF DESCRIPTION OF THE DRAWINGS

An embodiment of the invention is now described, by way of example only, with reference to the accompanying drawing in which.

DETAILED DESCRIPTION OF AN EMBODIMENT

According to an aspect of the invention, the rod allows the user to dispense a set amount of liquid onto the hair that is wrapped around the body of the rod. The rod containers one or more containers of hair perming liquids. The liquids may be the perming or setting solution, such solutions are known in the art and readily available. The amount of liquid contained in the container is a predetermined amount, designed to provide sufficient perming or setting solution to the hair that is in contact with the rod. Therefore, the amount of liquid dispensed is dependent on the length of the rod and the thickness of the rod, as this in turn determines the amount of hair that may be wrapped around the rod. The amount of liquid in a container is typically 5-10 ml, though this may change according to the type of hair, and perm.

In use, the user, such as a hair dresser, wraps the hair around the perming rod and dispenses the perming solution. The solution is dispensed from the perming rod and therefore contacts directly the hair wrapped around the perming rod. As the amount of liquid dispensed is dependent on the size of the container, the invention allows for set amounts of liquid to be dispensed thereby minimising the amount of chemicals used, and the possibility of the chemicals (which are often an irritant to skin) contacting the scalp of the person having the perm.

Additionally, the holes are designed to dispense an approximately equal amount of liquid per hole, thus ensuring a uniform application of the solution along the length of the body of the invention. Therefore, the present invention allows for the rapid and easy application of perming chemicals.

In use, the solution is dispensed from the perming rod and is typically left on the hair for ~20 minutes, though this is dependent on the solution used. After ~20 minutes the hair is washed to remove the solution, with the rods left in position. The user then dispenses the setting solution, causing the setting solution to dispensed from holes in the rod (in the preferred embodiment different holes to the ones that dispense the perming solution). The setting solution is left on for ~5 minutes, again dependent on the strength of solution used, the rods are removed and the hair is washed.

Figure 1:
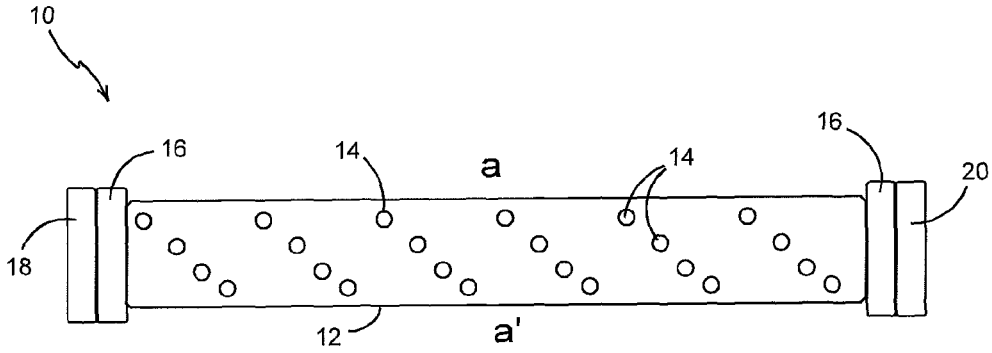
FIG. 1 is a perspective view of a hair perming rod according to an aspect of the invention.

FIG. 1 shows a hair perming rod according to an aspect of the invention, there is shown: a hair perming rod 10; body of the rod 12; plurality of holes 14; discs of the container 16; perming solution container 18 and setting solution container 20.

In use the user, such as a hair dresser, wraps the hair around the body of the rod 12. The hair may be held in place using a clip (not shown). The body of the rod 12 may be concave or convex according to the design of the rod 12 and the type of perm to be achieved. The size of the perming rod 10 is typically that of a normal perming rod, approximately 6 mm to 25 mm in diameter and approximately 5-10 cm long.

Along the outer surface of the body of the rod 12, there is a plurality of holes 14 from which liquid is dispensed. In the preferred embodiment, the size of the holes 4 varies according to the position of the hole along the body of the rod 12. The size of the holes varies from 0.5 to 5 mm. The positioning and size of the holes 14 are discussed in greater detail with reference to FIG. 3.

At either end of the rod 10, there are the discs of the containers 16. These are typically wider than the body of the rod 12 and are knurled so that the user may grip them. At either end of the rod 10, there is either a perming solution container 18 or a setting solution container 20. In a preferred embodiment, the body of the rod 12 is hollow, defining a volume space (see FIG. 2) and the containers extend within the hollow approximately half the length of the rod 12. The ends of the perming solution container 18 and setting solution container 20 preferably extend beyond the ends of the rod 10. In further embodiments, the containers 18 20 are placed outside of the body of the rod 12, however for reasons of size and space it is preferred that they are placed within the volume space of the body.

As described in further detail with reference to FIGS. 6, 7 and 8 the containers 18 20 have a twistable caps which initiates the dispensing of the liquid contained in the containers. In use, the user twists the knurled discs of the container 16 and the base of the container 18 or 20 which causes the liquid to follow, under pressure, in a series of channels (not shown in FIG. 1) which extend the length of the body of the rod 12. The channels are in fluid communication with the holes 14 and the pressure of the liquid flow, causes the liquid to be dispensed from the holes 14.

In further embodiments other suitable dispensing mechanisms may be used. In an embodiment, there is provided a pull string or tag for the user to pull to dispense the chemicals. In yet another embodiment, the rod 10 further comprises a spring mechanism which pushes a piston to dispense the liquid.

Figure 2:
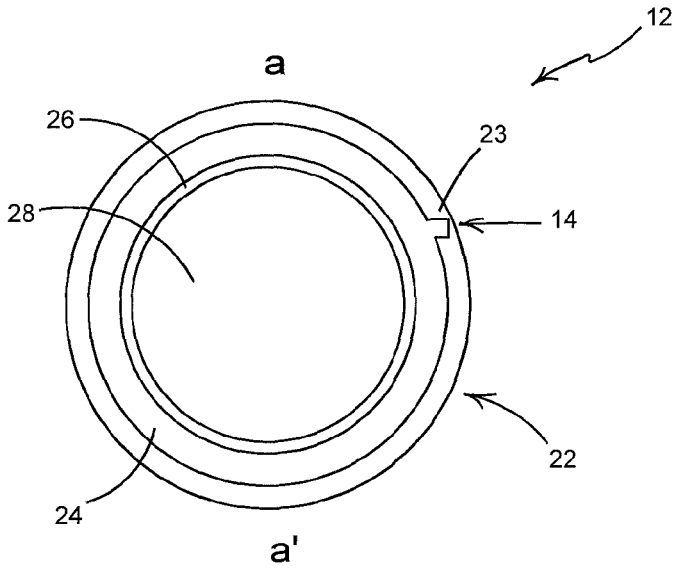
FIG. 2 is a cross sectional view along line a-a' of FIG. 1.

FIG. 2 is a cross sectional view along line a-a' of FIG. 1.

There is shown: body of the rod 12; hole 14; outer surface layer 22; channel layer 24; rifling layer 26 and volume space 28.

The outer surface layer 22, forms the visible part of the body of the rod and comprises the plurality of holes 14. As shown in FIG. 2, the holes 14 extend through the outer surface layer 22 and are in communication with the channel layer 24, through the communication channel 23. In the preferred embodiment, the outer surface layer 22 is made of a plastic resistant to the chemicals being used.

The channel layer 24 in the preferred embodiment is made of a plastic resistant to the chemicals being used and comprises a series of channels which extend the length of the body of the rod 12. In the preferred embodiment, the channel layer 24 comprises two separate channel groups which are not in communication with each other. Therefore the perming solution container 18 is associated with a first channel group and the setting solution container 20 is in communication with a separate channel group. As the perming solution and setting solution chemically neutralise each other, in order to increase the effectiveness of the solutions it is preferable that they do not mix within the channels of the rod 10. The form of the channel layer 24 is discussed in greater detail with reference to FIGS. 3 and 4. The communication channel 23 extends the length of the outer surface layer 22 thereby enabling liquid from the channel layer 24 to be transported to the outer surface of the rod 10.

The rifling layer 26 in the preferred embodiment is made of a hard plastic such as a thermoplastic. The rifling layer 26 is within the channel layer 24 and extends the length of the body of the rod 12. The structure of the rifling layer 26 is discussed in greater detail with reference to FIG. 5. The rifling layer defines a cavity or volume space 28. In the preferred embodiment, the volume space 28 is between 80% and 90% of the external diameter of the rod, and extends for the full length of the rod, sufficiently large for the perming solution container 18 and setting solution container 20 to fit inside the volume space 28. This allows the containers 18 20 to be mostly or fully located within the body of the rod 10 thereby minimising the space used for each rod 10.

Figure 3:
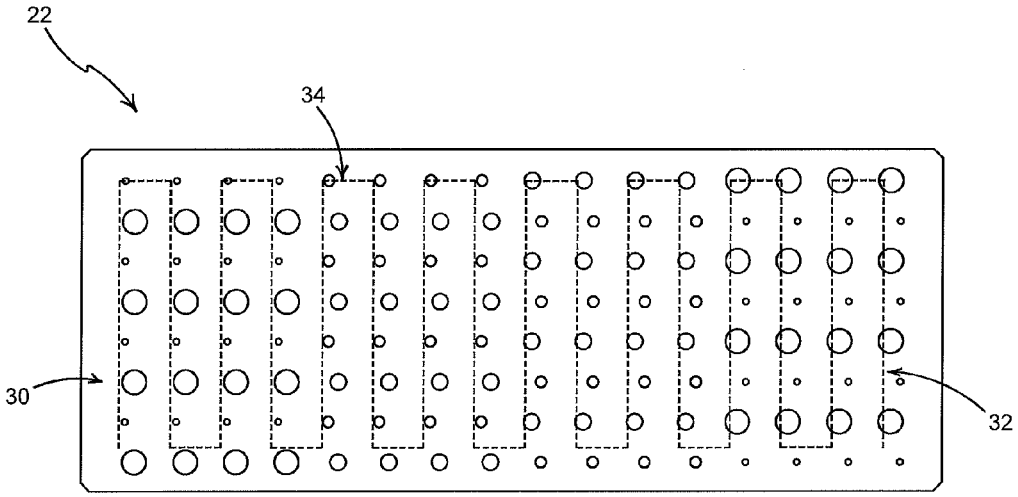
FIG. 3 shows an expanded view of the outer surface layer.

FIG. 3 shows an expanded view of the outer surface layer 22. There is shown: outer surface layer 22, comprising the plurality of holes 14, channel cap end 30 and channel opposite end 32. For ease of reference the holes 14 associated with a first channel are connected by the dotted line representing the path of the channel 34.

The channel cap end 30 represents the end of the outer surface layer that is closest to the cap of the containers 18 20 i.e. if the channel contains perming solution it is end at which the perming solution container 18 is located and vice versa for the setting solution container 20 and channel.

The size of the holes 14 increase from the channel cap end 30 to the opposite end 32. As the liquid is introduced at the base of the channel it will be introduced at a starting pressure determined by the initial motion of the piston. As the liquid is dispensed through the holes 14 and moves up the channel the pressure of the fluid flow will decrease. Therefore, in order to dispense an approximately constant amount of liquid per hole 14 the size of the hole changes along the length of the channel as the pressure decreases.

This is calculated as described below, and results in hole sizes that typically vary between 0.5 and 5 mm across the length of the channel.

In the preferred embodiment each hole delivers approximately the same rate of fluid flow—V milliliters/second This volume rate is the product of the surface area of the hole and the pressure which the liquid is under: V=P*S where P=f(D) and is a function of the distance between the hole and the end cap which is being turned to create the pressure.

The function f(D) is dependent upon the width and profile of the channel being used as well as the viscosity of the fluid chosen. It can easily be determined mathematically or empirically for a given set of these values.

Hence, a hole at distance D from the caps 18 20 will have surface area S=V/f(D) where V is the desired fluid flow and f is the function determined above.

In the preferred embodiment, there are 16 to 32 rows of holes per channel though this may change according to factors such as length of rod, amount of liquid to be dispensed etc.

In further embodiments other shaped dispensing means may be used. In an embodiment slots which vary in length and/or width are used to dispense a constant amount of fluid per slot.

Figure 4:
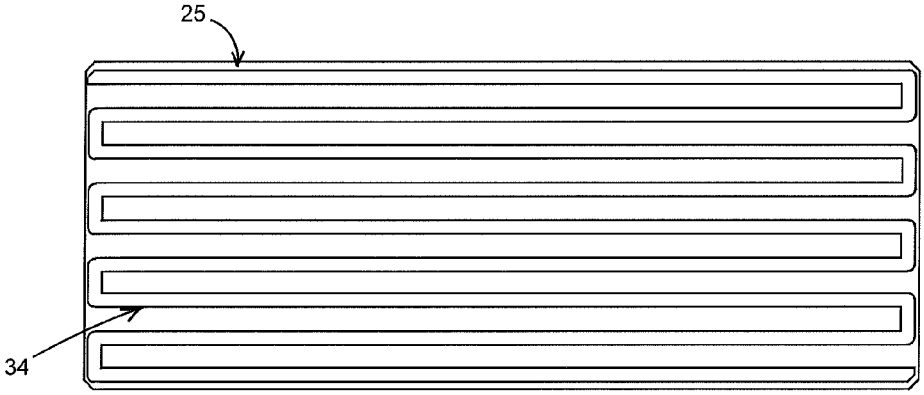
FIG. 4 shows an expanded view of the channel layer.

FIG. 4 shows an expanded example of a channel layer 24. The layer 24 is preferably made from a plastic resistant to the chemicals being used.

Figure 5:
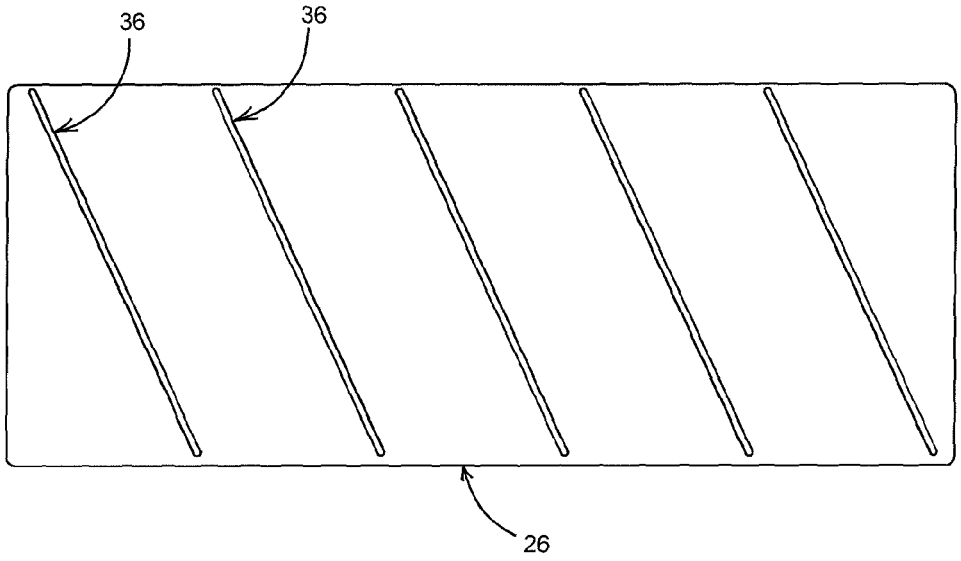
FIG. 5 shows an expanded view of the rifling layer.

FIG. 5 shows an expanded example of the rifling layer 26 and the rifling grooves 36. The rifling layer 26 is preferably made from a suitable hard plastic. The twist rate of the rifling layer 26 preferably remains constant throughout the length of the rifling layer 26, though in other embodiments the twist rate may vary. The depth of the rifling grooves 36 is typically 1 mm which is sufficient for the rifling grooves 36 to interact with the dispensing means of the containers (discussed with reference to FIG. 6).

The outer surface layer 22, channel layer 24 and rifling layer 26 form concentric layers which are designed to fit within each other as shown in FIG. 2. In further embodiments these layers may be made from a single plastic moulding.

Figure 6:
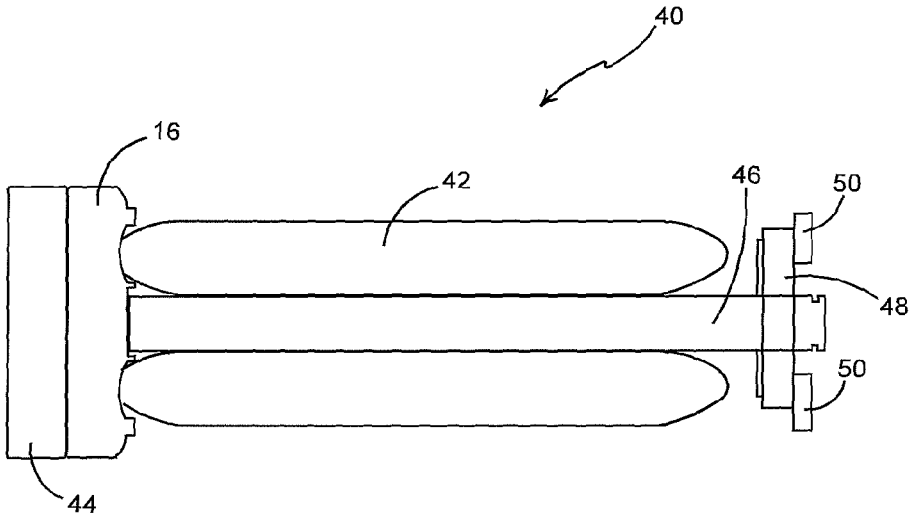
FIG. 6 is a perspective view of a container of solution and dispensing means.
Figure 7:
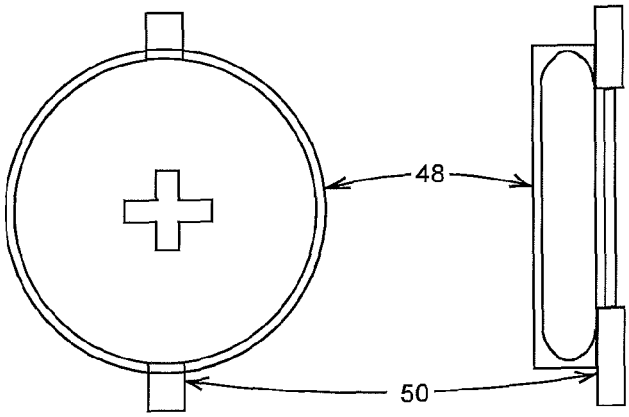
FIG. 7 shows the piston.

FIG. 6 is a perspective view of a container of solution, or cartridge, and dispensing means. The term container and cartridge are used interchangeably to describe the system used which has the liquid to be dispensed and the dispensing means. There is shown: disc of the container 16; container 40; vessel 42; end cap 44 (which is equivalent to the visible parts of the container 18 20 in FIG. 1); connecting rod 46; piston 48; and lugs 50.

In the preferred embodiment the end cap 44 and disc of the container 16 are joined via a connecting seal made of a thin strip of plastic (not shown) which is breakable under pressure. This ensures that the end cap 44 and disc of the container 16 do not move relative to each other accidentally. The connecting rod 46 is fixedly attached to the end cap 44. The connecting rod 46 is preferably cruciform in shape, though other shapes of connecting rod 46 may be used. The vessel 42 is made from a deformable plastic. The vessel 42 may either be either annulus shaped, with the connecting rod 46 inserted through the centre of the annulus, or in a further embodiment is a rectangular bag which is wrapped around the connecting rod 46. The rectangular bag embodiment is preferred on the basis of costs, as it is significantly cheaper to manufacture a rectangular bag than an annular bag. The vessel 42 is sealed and attached to the disc 16. The disc 16 has a small projection (not shown) where the vessel 42 is attached to the disc 16.

At the end of the connecting rod 46 opposite to the end cap 44 is the piston 48, upon which is fixedly attached two lugs 50. The piston 48 is moveably attached to the connecting rod 46 and therefore is enabled to move along the length of the connecting rod 46. The piston 48 is made from a solid plastic disc with a cruciform hole in the centre so as to accept the connecting rod 46 (as shown in FIG. 7). The connecting rod 46 at the end opposite the end cap 44 preferably has a stopper (not shown) to prevent the piston 48 from moving off the end of the connecting rod 46.

In use, the container 40 is inserted into the volume space 28 of the rod 10. As the rod 10 is intended to hold a container 40 for perming solution 18 and setting solution 20 the entire length of the container 40 is preferably half that of the rod 10. The user holds the knurled disc of the container 16 and the end cap 44 and twists them in opposite directions. The twisting motion is sufficient to break the connecting seal between the disc 16 and end cap 44. As the connecting rod is fixedly attached to the disc 16 the connecting rod turns within the volume space. The lugs 50 cooperate with the rifling 36 of the rifling layer 26 causing the piston 48 to move up or down the length of the connecting rod 46, depending on which direction the disc 16 is twisted. The downward movement of the piston 48 compresses the vessel 42 which causes the vessel 42 to be punctured by the small projection in the disc 16. The continued downward movement of the piston 48 caused the liquid held in the vessel 42 to be dispensed from the puncture in the vessel 42.

In further embodiments, the connecting rod 46 is fixedly attached to the end cap 44. The user pulls the end cap 44 from the disc 16 causing the piston 48 to move towards the disc 16 and compress the vessel 42. However, as this results in the end cap 44 moving away from the rod 10 and requiring more space, this is a less preferred embodiment.

In further embodiments other dispensing means may be used. The described embodiment is preferred as it allows for easily manufacturable parts to be used, which do not require high tolerances or made to precise specifications. The described embodiment of the container 40 may be manufactured at a cost of a few pence per unit.

Figure 8:
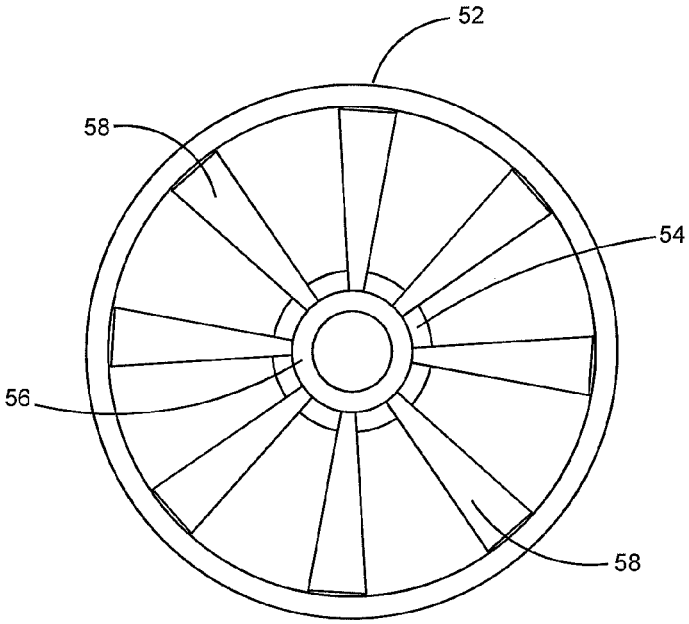
FIG. 8 shows the disc of the container.

FIG. 8 shows an embodiment of the disc 16, which allows liquid from the vessel 42 to flow into the channel layer 24. There is shown: knurled outer layer 52; inner layer 54; base of vessel 56; disc channels 58; inner volume space for connecting rod and vessel 60.

The disc comprises an upper part (a part that is contact with the base of the body of the rod 12) and a lower part (in contact with the end cap 44). The upper and lower part of the disc are substantially similar in design and are as shown in FIG. 8.

The upper part is a disc slightly larger in diameter than the body of the rod 12 with a knurled outer rim 52. The inner rim 54 defines an inner volume space for connecting rod and vessel 60. The inner rim 54 further comprises one or more projections (not shown). The base of the vessel 56 is in contact with the inner rim 54 of the disc. Disc channels 58 extend from the inner rim 54 to the knurled outer rim 52.

The lower part of the disc is connected to the upper part of the disc so that the disc channels 58 align thereby providing a series of channels from the inner rim 54 to the knurled out rim 52.

In use the vessel 42 is placed around the connecting rod 46, as shown in FIG. 6. The base of the vessel 56 is in contact with the inner rim 54 of the disc 16. The projections on the inner rim 54 are in contact with the base of the vessel 56. The user twisting the disc 16 and the end cap 44 causes the projections to puncture the base of the vessel 56 and the compression of the piston 48 causes fluid to flow from the vessel 42 into the disc channels 58. The disc channels 58 align to the channels in the channel layer 24, thereby introducing liquid from the vessel into the channel layer 24, thus allowing the liquid to be dispensed via the communication channels 24 to the holes 14.

Whilst the above embodiment describes the fluid being dispensed from the base of the vessel 56 into the channel, in further embodiments, the vessel 42 may dispense liquid at several points along the length of the body of the rod 12. For example, the connecting rod 46 may expand causing the vessel 42 to puncture at various locations and introduce the liquid into the channel layer 24 at various locations. This would also allow the holes 14 to be approximately constant in size.

The invention claimed is:

1. A rod for dispensing liquid to enable the perming of hair, wherein the rod comprises:

a body around which in use hair is wrapped, said body comprising:

a plurality of holes; and a chamber for holding liquid to be dispensed;

a first channel extending at least part of the length of the body, the first channel in fluid communication with the chamber and the plurality of holes;

wherein the plurality of holes are sized such that in use a substantially equally amount of liquid is dispensed from each hole, wherein the hole size varies as a function of the distance of the hole from a dispensing means and wherein the hole size for the holes in communication with the first channel increases in size from a first end of the first channel, thereby enabling an approximately equal amount of liquid to be dispensed from each hole at a given pressure to contact the hair wrapped around the rod to enable perming of the hair.

2. A rod according to claim 1 wherein said body comprising:

an outer surface comprising the plurality of holes;

an inner surface comprising the first channel;

a first container of liquid to be dispensed, said first container being positionable so as to be in fluid communication with said first channel;

wherein in use, the first container introduces the liquid into the first channel and said liquid is dispensed via the holes in the outer surface of the rod.

3. A rod according to claim 1 wherein the body is hollow and defines a volume space in which a first container of liquid may be placed and wherein the first container of liquid further comprises a dispensing means.

4. A rod according to claim 3 wherein the first container is placed within the volume space of the body and the dispensing means is outside of the volume space of the body.

5. A rod according to claim 3 wherein the dispensing means is a piston that compresses at least part of the first container of liquid.

6. A rod according to claim 3 wherein the dispensing means is a compressible means.

7. A rod according to claim 3 wherein the dispensing means comprises:

a first end, a second end, the first container of liquid, and a connecting rod, which when in use said first end is located in the volume space of the body, said second end is located outside of the body, the connecting rod connects the first and second end and the first container of the liquid is placed between the first and second ends;

the first end comprising a moveable cap with one or more projections that communicate a plurality of grooves of an inner layer of the body, said moveable cap comprising a substantially central hole which is enabled to receive the connecting rod;

the second end fixable attached to the connecting rod;

wherein in use the turning of the second end, causes the connecting rod and first end to turn, the projections of the moveable cap cooperate with the grooves of the inner layer if the body thereby causing the movable cap to move along the length of the connecting rod.

8. A rod according to claim 7 wherein the connecting rod is of cruciform shape.

9. A rod according to claim 7 wherein the second end is in communication with the first container of liquid and further comprises one or more channels to receive the liquid from the first container when the first end approaches the second end.

10. A rod according to claim 7 wherein the connecting rod is container substantially within the body of the perming rod.

11. A rod according to claim 1 wherein the perming rod comprises one or more further containers of liquid and one or more further channels, each further container of liquid positionable to be in fluid communication with at least one of the further channels.

12. A rod according to claim 11 wherein each channel is only in fluid communication with one container of liquid.

13. A rod according to claim 1 wherein a container of liquid is in communication with the first channel at a base of the body, and the dispensing of liquid from the container causes the fluid to flow substantially the length of the first channel.

14. A rod according to claim 1 wherein a container of liquid is in fluid communication with a plurality of locations along the length of the first channel.

15. A rod according to claim 1 wherein there are two containers of liquid, each container being in communication with a different channel, and preferably extending approximately half the length of the rod.

16. A rod according to claim 15 wherein the containers contain perm solution and perm setting liquid.

17. A rod according to claim 1 wherein the body further comprises an inner layer, beneath an inner surface comprising the first channel, said inner layer comprising a plurality of grooves to guide a container to a position.

18. A rod according to claim 1 wherein the container of liquid is a deformable bag.

19. A rod according to claim 1 wherein the holes are in the form of a slit.

* * * * *